United States Patent [19]

Becker et al.

[11] Patent Number: 4,639,169

[45] Date of Patent: Jan. 27, 1987

[54] MINERAL MINING INSTALLATION

[75] Inventors: Kunibert Becker, Werl; Rüdiger Kirchbrücher, Dortmund-Brackel; Michael Preuschoff, Lüdinghausen, all of Fed. Rep. of Germany

[73] Assignee: Gewerkschaft Eisenhutte Westfalia, Fed. Rep. of Germany

[21] Appl. No.: 696,559

[22] Filed: Jan. 30, 1985

[30] Foreign Application Priority Data

Feb. 4, 1984 [DE] Fed. Rep. of Germany ..... 3403906

[51] Int. Cl.[4] ..... E21D 15/44

[52] U.S. Cl. ..... 405/291; 91/170 MP; 405/299; 92/13.3; 92/13.41; 92/13.7

[58] Field of Search ..... 92/13, 13.4, 13.7, 13.41, 92/13.3; 91/170 MP; 405/291, 292, 293, 294, 295, 296, 297, 298, 299, 300, 301

[56] References Cited

U.S. PATENT DOCUMENTS 3,042,121 7/1962 Broetzman et al. ..... 92/13.7
4,227,833 10/1980 Plester ..... 405/299
4,379,424 4/1983 Rosenberg ..... 92/13.41
4,449,859 5/1984 Terhorst ..... 405/291

FOREIGN PATENT DOCUMENTS 23831 of 1912 United Kingdom ..... 92/13
2051956 1/1981 United Kingdom ..... 92/13
901675 2/1982 U.S.S.R. ..... 92/117 A

*Primary Examiner*—Abraham Hershkovitz
*Attorney, Agent, or Firm*—Sughrue, Mion, Zinn, Macpeak & Seas

[57] ABSTRACT

A mineral mining installation comprises a roof support unit and an advance mechanism. The roof support unit has a floor sill constituted by two floor girders. The advance mechanism comprises a hydraulic advance ram, the advance ram having a relatively-displaceable cylinder and a piston rod, and a device for selectively limiting the working stroke of the ram. The stroke-limiting device comprises a stop fixed to the cylinder of the advance ram, and an adjustable stop member which is mounted on the side wall of one of the floor girders.

11 Claims, 4 Drawing Figures

16; 21
8
17
7
11
3
10
9
12
10
15
14
11

16; 21
6
X
X'
X''
8
8
5
17
10
11
3
2'
2
4
10
14; 13
15
1
13'
9
12
13''
S
9
7

6
7
2
3
17
4
21
19
12

1
6
6'
16;21
16;21
5
5'
X
3
3'
17
21
21
2
18
4
4'
19
19'
10
10
7
12
20
12
7

MINERAL MINING INSTALLATION

BACKGROUND TO THE INVENTION

This invention relates to a mineral mining installation, and in particular to an advance mechanism for a mine roof support unit.

It is known to employ, in a mineral mining installation, hydraulic advance rams for connecting movable roof support units to a scraper-chain conveyor arranged alongside a mineral face. The advance rams are extended and retracted alternately, from time-to-time, to advance the conveyor towards the mineral face, and to draw up the roof support units to follow this conveyor advance movement. In most case, the advance rams are extended and retracted by their full working stroke; but, under certain conditions, it may be necessary to displace the conveyor section (or the roof support unit associated with a given ram) by a distance somewhat less than the full working stroke of the ram. Use can then be made of a device which serves to limit the working stroke of the ram to a distance less than its full working stroke.

For example, U.S. Pat. No. 4,379,424 describes a hydraulic advance ram having a stop member between its cylinder and its piston rod. The stop member partially surrounds the piston rod, and is engageable with the cylinder to vary the working stroke of the ram. However, adjustment of the working stroke of this known type of ram is a relatively complicated matter, particularly in view of the limited amount of space available in a congested mine working.

The aim of the invention is to provide an advance mechanism having a stroke-limiting device which can be adjusted in the simplest possible manner.

SUMMARY OF THE INVENTION

The present invention provides a mineral mining installation comprising a roof support unit and an advance mechanism, the roof support unit having a floor sill constituted by at least one floor girder, and the advance mechanism comprising a hydraulic advance ram, the advance ram having a relatively-displaceable cylinder and a piston rod, and a device for selectively limiting the working stroke of the ram, wherein the stroke-limiting device comprises a stop fixed to a movable part of the advance ram, and an adjustable stop member which is mounted on a roof support unit floor girder.

Thus, with this advance mechanism, the adjustable part of the stroke-limiting device (the stop member) is mounted on said girder, and so is readily accessible, and easily adjustable.

Advantageously, the adjustable stop member is located, at least partly, on that part of said floor girder adjacent to a working face. Thus, the stop member can be easily reached by an operator.

In a preferred embodiment of the invention, the adjustable stop member is constituted by a rod which can be fixed to said floor girder in any one of a plurality of positions. Advantageously, the rod is adjustably mounted on at least one bracket, the or each bracket being fixed to said floor girder, and the rod being slidably mounted in a passage in the or each bracket. Preferably, the rod is provided with a plurality of longitudinally-spaced holes, and a given bracket is provided with a single hole which is alignable selectively with each of the holes in the rod, and wherein a pin is provided for locking the rod to said bracket by passing through the hole in said bracket and an aligned hole in the rod. Adjustment of the stop member can, therefore, be carried out in a simple manner by displacing the rod and then immobilising it by inserting the pin through a different pair of aligned holes.

The stop that co-operates with the stop member can, in principle, be provided on any part of the advance mechanism that is displaceable in the advance direction. However, the stop is preferably constituted by a slide member which slidably guides the advance mechanism on said floor girder.

The walking mechanism in accordance with the invention can be used as an "internal advance mechanism", which is arranged between the two floor girders of a single roof support unit, and as an "external advance mechanism", which is arranged between the adjacent floor girders of a pair of adjacent roof support units. Both in the internal and external forms of advance mechanism, a stroke-limiting device can be provided either on the side wall of one adjacent floor girder or on the side walls of both adjacent floor girders.

Thus, for an external advance mechanism, the installation may further comprise a second roof support unit, each of the roof support units having a floor sill constituted by a pair of floor girders, wherein the advance mechanism is positioned between the adjacent floor girders of the two roof support units. In this case, it is preferable for the advance mechanism to have two hydraulic advance rams, each of which is provided with a stroke-limiting device; each stroke-limiting device having a stop fixed to a movable part of the associated advance ram, and an adjustable stop member mounted on the adjacent floor girder. It is then possible to make different adjustments to the working strokes of the two advance rams. This enables the roof support units to be aligned, and this is particularly advantageous when the installation is positioned in an inclined working. For an external advance mechanism, each stop may be constituted by a slide member which slidably guides the advance mechanism on the associated floor girder. Conveniently, each adjustable stop member acts as a guide for the associated slide member, so that special guide members for the slide members are not required.

BRIEF DESCRIPTION OF THE DRAWINGS

Two forms of advance mechanism, each of which is constructed in accordance with the invention, will now be described, by way of example, with reference to the accompanying drawings, in which.

DESCRIPTION OF PREFERRED EMBODIMENTS

Figure 1:
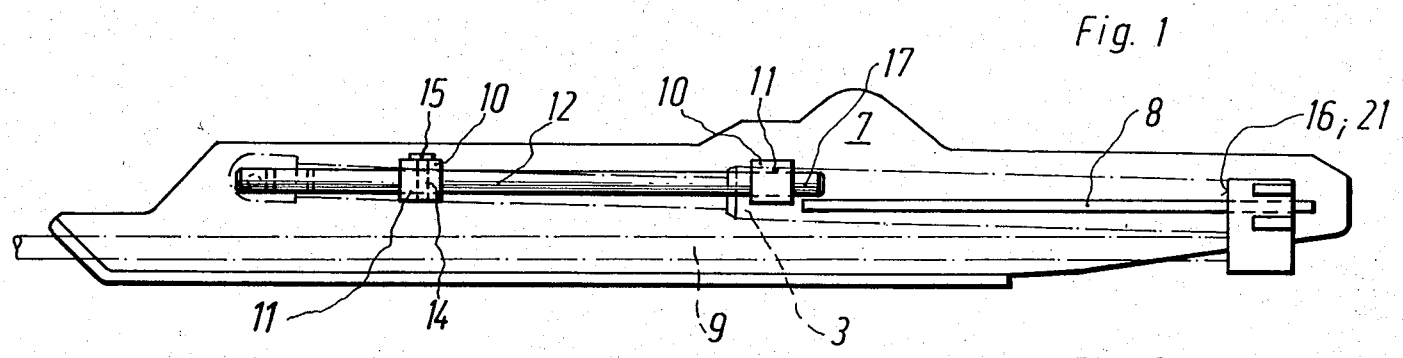
FIG. 1 is a side elevation of the first form of advance mechanism, the advance mechanism being arranged between the floor girders of a mine roof support unit.
Figure 2:
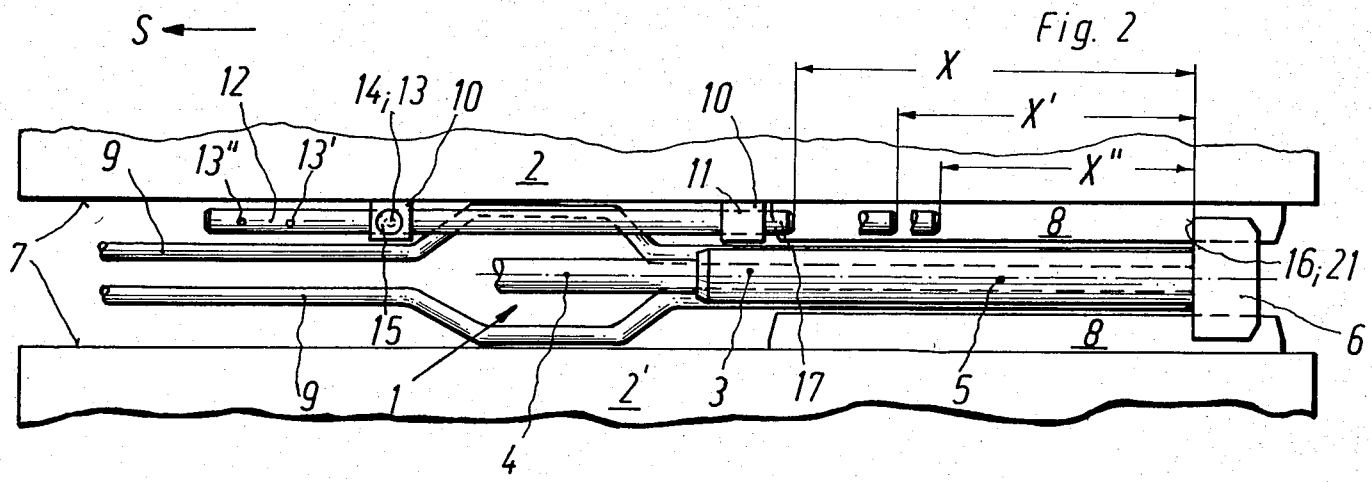
FIG. 2 is a plan view of the advance mechanism of FIG. 1.

Referring to the drawings, FIGS. 1 and 2 shows an advance mechanism 1 arranged between the two floor girders 2, 2' of a mine roof support unit, no further details of which are shown. The advance mechanism 1 has a hydraulic advance room 3, the piston rod 4 of which is connected to a cross member (not shown) which interconnects the two floor girders 2, 2', the connection optionally being in the form of a hinge. A slide ring 6 is provided at the goaf-side end of the cylinder 5 of the advance ram 3, the slide ring 6 being guided (in the direction S of advance) by means of guide plates 8 welded to the mutually-facing side walls 7 of the floor girders 2, 2'. The goaf-side ends of two guide rods 9 are also connected to the slide ring 6, the face-side ends of the guide rods being connected to a longwall conveyor (not shown). The guide rods 9 are of circular cross-section, and are made of resilient material. The advance ram 3 and the guide rods 9 are shown only in dash-dot lines in FIG. 1 so as to make the drawing clearer.

Two brackets 10 are mounted on the side wall 7 of the floor girder 2. Each bracket 10 defines a passage 11, the two passages being coaxial and extending parallel to the advance direction S. A rod 12 is slidably mounted, with respect to the brackets 10, in the passages 11. The face-side end zone of the rod 12 is provided with a number of substantially vertical holes 13, 13' and 13'', which are arranged side-by-side. The face-side bracket 10 is also provided with a substantially vertical hole 14. By means of the holes 13, 13', 13'' and 14, and with the help of a pin 15, the rod 12 can be secured to the brackets 10 (and therefore to the floor girder 2). Depending upon which of the holes 13, 13' and 13'' registers with the hole 14 in the face-side bracket 10, the distance between the goaf-side end 17 of the rod 12 and the face-side edge 16 of the slide ring 6 varies. Thus, the maximum working stroke of the advance ram 3 also varies, as it is limited by engagement of the edge 16 of the slide ring 6 with the goaf-side end 17 of the rod 12. The goaf-side end 17 thus acts as a stop member.

The working stroke of the advance ram 3 can be adjusted by moving the pin 15, displacing the rod 12, and inserting the pin 15 at another point. Since the bracket 10 accommodating the pin 15 is arranged relatively close to the face-side end of the floor girder 2, an operator can carry out the adjustment relatively easily, even in the congested conditions that prevail when roof support units are used to win mineral material from thin seams.

Figure 3:
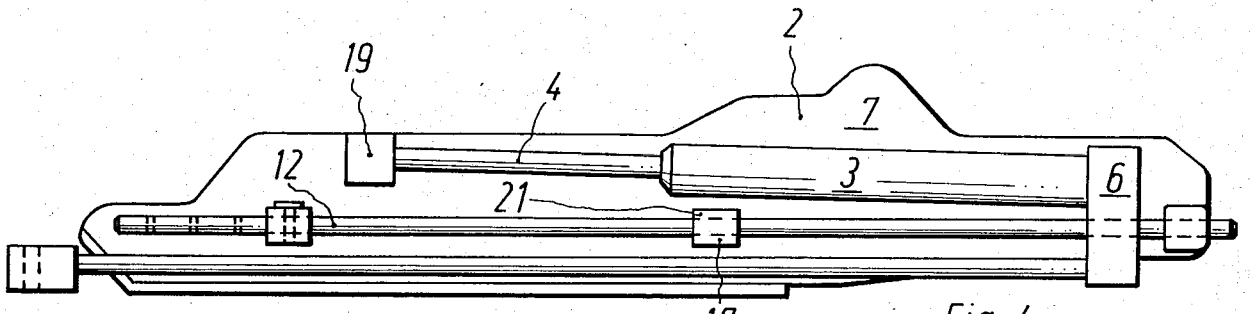
FIG. 3 is a side elevation of the second form of advance mechanism, the advance mechanism being arranged between the two adjacent floor girders of a pair of adjacent roof supports units.
Figure 4:
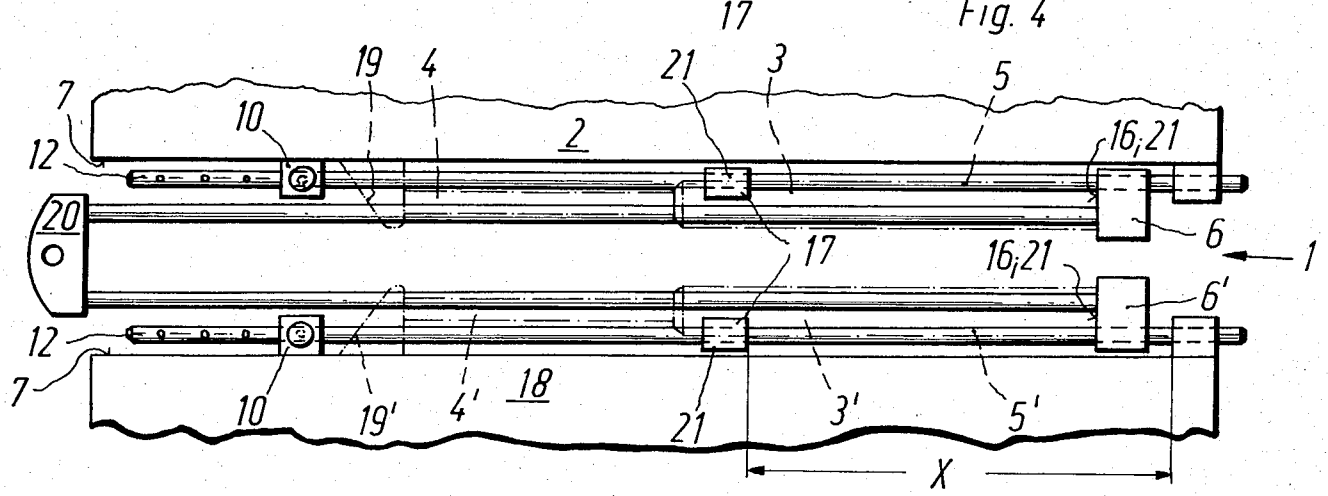
FIG. 4 is a plan view of the advance mechanism of FIG. 3.

In contrast to the advance mechanism shown in FIGS. 1 and 2, the advance mechanism 1 shown in FIGS. 3 and 4 is arranged between the adjacent floor girders 2 and 18 of two adjacent roof support units. Here again, no further details of the roof support units are shown. The advance mechanism 1 has two hydraulic advance rams 3, 3', the piston rods 4, 4' of which are connected to respective bearing blocks 19, 19'. The bearing blocks 19, 19' are connected respectively to the floor girders 2 and 18. A respective slide ring 6, 6' if provided at the goaf-side end of the cylinder 5, 5' of each of the two advance rams 3, 3'. A respective guide rod 9 is attached to each of the slide rings 6, 6', the face-side ends of the guide rods being connected, by a common cross member 20, to a longwall conveyor (not shown).

A respective pair of brackets 10 are mounted on the mutually-facing side walls 7 of the two floor girders 2 and 18. As with the embodiment of FIGS. 1 and 2, the brackets 10 define passages 11, the passages of each pair of brackets being coaxial and parallel to the advance direction S. A respective rod 12 is slidably mounted in the passages 11 of each pair of brackets 10. Each of the rods 12 is also provided with a plurality of substantially vertical holes at its goaf-side end, and each face-side bracket 10 is provided with a substantially vertical hole. Thus, as with the embodiment of FIGS. 1 and 2, each rod 12 can be fixed relative to its pair of brackets 10 (and hence to the associated floor girder 2 or 18) in one of a plurality of positions. A respective sleeve 21 is fixed to each of the rods 12 pary way therealong. The goaf-side edge of each sleeve 21 is engageable with the face-side edge 16 of the associated slide ring 6 to limit the working stroke X of the corresponding advance ram 3. Thus, by adjusting the positions of the rods 12 relative to their face-side brackets 10, it is possible to adjust the working strokes of the rams 3.

Since the two floor girders 2 and 18 are associated with two adjacent roof support units, the lateral distance between them is not precisely fixed. For this reason, the slide rings 6, 6' must be movable not only vertically but laterally. In this embodiment, therefore, the rods 12 not only act as stop members, but also as guides for the slide rings 6, 6'.

Since the rods 12 can be adjusted relative to the floor girders 2 and 18 to different positions, it is possible to retract the two floor girders of a given roof support unit to different extents, and thus to apply an alignment action to the roof support units. Although an alignment action of this kind is possible with the prior art arrangements, the adjustment and correction of this alignment action can be carried out in a particularly simple manner with advance mechanisms made in accordance with the invention.

We claim:

1. A mineral mining installation comprising a roof support unit and an advance mechanism, said roof support unit having a floor sill constituted by at least one floor girder, said advance mechanism comprising a hydraulic advance ram, said advance ram having a relatively-displaceable cylinder and a piston rod, and a device for selectively limiting the working stroke of the ram, the improvement wherein said stroke-limiting device comprises a stop fixed to a movable part of the advance ram, and an adjustable stop member mounted on a roof support unit floor girder, said adjustable stop member comprising a rod, means for fixing said rod to said floor girder in any one of a plurality of positions, and wherein, said rod fixing means comprises at least one bracket fixed to said floor girder, and a passage in said at least one bracket slidably mounting said rod and means for locking said rod at a longitudinally adjustable position relative to said at least one bracket.

2. An installation according to claim 1, wherein the adjustable stop member is located, at least partly, on that part of said floor girder adjacent to a working face.

3. An installation according to claim 1, wherein the rod is adjustably mounted on a pair of brackets.

4. An installation according to claim 3, wherein the rod includes a plurality of longitudinally-spaced holes, and one of said brackets is provided with a single hole which is alignable selectively with each of the holes in the rod, and wherein a pin is provided for locking the rod to said one bracket by passing through the hole in said one bracket and an aligned hole in the rod.

5. An installation according to claim 1, wherein the stop is a slide member which slidably guides the advance mechanism on said floor girder.

6. An installation according to claim 1, wherein the roof support unit has two floor girders, and the advance mechanism is arranged between the two floor girders of the roof support unit.

7. An installation according to claim 6, wherein the adjustable stop member is mounted on the side wall of said floor girder.

8. An installation according to claim 1, further comprising a second roof support unit, each of the roof support units having a floor sill comprising a pair of floor girders, wherein the advance mechanism is positioned between the adjacent floor girders of the two roof support units.

9. An installation according to claim 8, wherein the advance mechanism has two hydraulic advance rams, each of which is provided with a stroke-limiting device; each stroke-limiting device having a stop fixed to a movable part of the associated advance ram, and an adjustable stop member mounted on the adjacent floor girder.

10. An installation according to claim 9, wherein each stop is a slide member which slidably guides the advance mechanism on the associated floor girder.

11. An installation according to claim 10, wherein each adjustable stop member acts as a guide for the associated slide member.

* * * * *